US005791541A

United States Patent [19]

Jitsuishi et al.

[11] Patent Number: 5,791,541

[45] Date of Patent: Aug. 11, 1998

[54] TENSION CONTROLLER FOR CONTROLLING TENSION OF RUNNING PAPER WEB

[75] Inventors: Yasuo Jitsuishi; Seiji Suzuki, both of Yokohama; Noboru Fujio, Hamura, all of Japan

[73] Assignee: Tokyo Kikai Seisakusho, Ltd., Tokyo, Japan

[21] Appl. No.: 869,734

[22] Filed: Jun. 5, 1997

[30] Foreign Application Priority Data

Dec. 24, 1996 [JP] Japan ..... 8-355419

[51] Int. Cl.[6] ..... B65H 26/00; B65H 23/16

[52] U.S. Cl. ..... 226/40; 226/44; 226/118.2; 242/418.1

[58] Field of Search ..... 226/40, 44, 8, 226/118.2; 242/417.1, 418.1

[56] References Cited

FOREIGN PATENT DOCUMENTS

| | | |
|---|---|---|
| 61-261054 | 11/1986 | Japan . |
| 4-341450 | 11/1992 | Japan . |
| 5-116823 | 5/1993 | Japan . |
| 6-127773 | 5/1994 | Japan . |

*Primary Examiner*—Michael Mansen

*Attorney, Agent, or Firm*—Armstrong, Westerman, Hattori, McLeland & Naughton

[57] ABSTRACT

A tension controller for controlling the tension of running paper web. When a rotary press starts to operate and performs a minimum speed operation, the controller balances the tension of the paper web between a floating roller and a dancer roller, thereby easily bringing the dancer roller to the central position of its swing stroke. Also, the tension controller deactivates a dancer roller positioning mechanism in accordance with an acceleration signal before an impression on signal for starting printing is issued, thereby smoothly initiating tension control from the beginning of printing. Further, the displacement range of the dancer roller is divided into a plurality of regions. Based on values detected by three detection sensors for the dancer roller, namely a displacement direction detection sensor, a displacement speed detection sensor, and a displacement position detection sensor, the tension controller controls the driving time of an infeed roller drive transmission regulation unit. Through smooth, stable tension control performed from the beginning of printing, the controller minimizes tension variations, shortens time required until the tension is stabilized, and reduces detection and calculation errors, thereby providing high-accuracy control.

8 Claims, 5 Drawing Sheets

TENSION CONTROLLER FOR CONTROLLING TENSION OF RUNNING PAPER WEB

BACKGROUND OF THE INVENTION

1. Field of the Invention

The present invention relates to a tension controller for controlling the tension of running paper web in a rotary press, and particularly to a tension controller for controlling the tension of running paper web capable of reducing variations in the tension of the running paper web after printing starts, and of stabilizing the tension of the running paper web within a short period of time after printing starts.

2. Description of the Related Art

A conventional tension controller for controlling the tension of running paper web in a rotary press is disclosed, for example, in Japanese Patent Application Laid-Open (kokai) Nos. 4-341450, 5-116823, 6-127773, and 61-261054.

The tension controller for a running continuous body disclosed in Japanese Patent Application Laid-Open (kokai) No. 4-341450 comprises: a speed regulation unit for regulating the speed of the running continuous body; a tension detection unit for detecting the tension of the running continuous body; a speed detection unit for detecting the speed of the running continuous body; a speed control unit for calculating the difference between a predetermined tension and the tension detected by the tension detection unit to thereby generate a speed regulation signal to be output to the speed regulation unit; a rotational drive unit for swinging the arm of a dancer roller comprising an electropneumatic conversion unit and an air cylinder; a position detection unit for detecting the swing position of the dancer roller; and a dancer roller control unit for calculating the difference between a predetermined standard swing position of the dancer roller and the swing position detected by the position detection unit to thereby generate a rotational drive signal to be output to the rotational drive unit.

The tension controller for the running continuous body controls the position of the dancer roller in the following manner. The position detection unit detects the position of the dancer roller. The difference between the detected swing position and a predetermined swing position is calculated. The thus-calculated difference is converted into an electric current having a magnitude corresponding to the difference, which is input into the electropneumatic conversion unit. Thus, the dancer roller is controlled so as to be maintained at the predetermined position.

The speed of the running continuous body is controlled in the following manner. The tension of the continuous body is detected by the tension detection unit. The difference between the detected tension and a predetermined tension is calculated. Also, an output from the speed detection unit is converted into a voltage. These difference and voltage values are added together. A signal is generated based on the thus-calculated sum and is then input into the speed regulation unit to accordingly control the speed of the running continuous body. Thus, control is performed such that the detected speed corresponds to the predetermined tension.

The speed of response of the positional control of the dancer roller is set so as to be sufficiently lower than that of the tension control of the running continuous body in a speed control circuit.

The tension controller for a sheet-like material disclosed in Japanese Patent Application Laid-Open (kokai) No. 5-116823 comprises: a tension detection unit for detecting the tension of the sheet-like material; a subtraction unit for calculating the difference between a predetermined tension and the tension detected by the tension detection unit; a position detection unit for detecting the position of a dancer roller; a subtraction unit for calculating the difference between a predetermined standard position of the dancer roller and the position of the dancer roller detected by the dancer roller position detection unit; a differentiation unit for calculating a swing speed of the dancer roller; a speed detection unit for detecting a motor speed; a subtraction unit for calculating the difference between a predetermined speed and the speed detected by the speed detection unit; a calculation unit for calculating a speed correction amount for the motor based on the above calculated values; and a calculation unit for calculating a speed instruction value based on the calculated speed correction amount.

In the above-described tension controller for the sheet-like material, the tension of the sheet-like material is controlled in the following manner. The tension detection unit detects the tension of the sheet-like material, and a deviation of the detected tension from a predetermined tension is calculated. The position detection unit detects the position of the dancer roller, and a deviation of the detected position from the standard position is calculated. The swing speed of the dancer roller is also calculated. The speed detection unit detects a motor speed, and a deviation of the detected motor speed from a predetermined speed is calculated. A speed correction amount for the motor is calculated based on these calculated values, and a speed instruction value for the motor is calculated based on the calculated speed correction amount, to thereby control the motor speed and thus maintain the tension of the sheet-like material at a constant value.

The tension controller in a rotary press disclosed in Japanese Patent Application Laid-Open (kokai) No. 6-127773 performs control in the following manner. Based on an output from a tension detection unit and an output from an encoder used for detecting a swing position of a dancer roller, a control unit controls the rotational speed of a paper roll rotating motor. Also, the control unit controls a solenoid valve used for feeding compressed air to an air brake unit for braking the swing shaft of the dancer roller.

When the rotary press starts, the control unit actuates the solenoid valve so as to feed compressed air to the air brake unit for braking the swing shaft of the dancer roller, thereby fixing the dancer roller at the central position of its swing stroke. Thus, the encoder does not issue an output to the control unit, so that the rotational speed of the paper roll rotating motor is controlled by the control unit based only on the output of the tension detection unit.

When the rotary press reaches a predetermined operation speed, the control unit actuates the solenoid valve so as to release compressed air from the air brake unit, thereby allowing the dancer roller to swing. Thus, the motor speed is controlled by the control unit based on the outputs of the tension detection unit and the encoder.

Japanese Patent Application Laid-Open (kokai) No. 61-261054 discloses a starting unit of a rotary press equipped with a dancer roller type infeed tension controller which comprises a dancer roller position detection unit, a drag roller speed changer, and a speed change ratio control unit. The starting unit comprises a dancer roller stopper adapted to mechanically hold a dancer roller at the central position of its swing stroke and mounted on the dancer roller, a cylinder application/release detection unit for detecting whether the cylinder is applied for printing or released, and a control unit for controlling whether the dancer roller stopper is activated or deactivated.

In the starting unit of the rotary press, before impression is turned on, the cylinder application/release detection unit detects this state and generates an impression off signal. In response to this impression off signal, the dancer roller stopper control unit causes the dancer roller stopper to be fixed, thereby maintaining the dancer roller at the central position of its swing stroke.

When impression is turned on, the cylinder application/release detection unit detects this state and generates an impression on signal. In response to this impression on signal, the dancer roller stopper control unit causes the dancer roller stopper to be released.

Also, before and after impression is turned on, the speed change ratio control is performed for an infeed roller by the dancer roller position detection unit, the speed change ratio control unit, and the speed changer such that the dancer roller is always positioned at the central position of its swing stroke.

The above-described prior art involves the following problems.

The tension controller disclosed in Japanese Patent Application Laid-Open (kokai) No. 4-341450 comprises the speed control unit and the dancer roller control unit. The speed control unit performs control such that it makes a keen correction for short-term variations or small variations in tension while avoiding an excessive correction for large variations in tension, which are absorbed by a swing of the dancer roller.

The dancer roller control unit performs control so as to cope with large or gentle variations in tension and such that when the dancer roller is, on average, positioned at the substantial center of its swing stroke. Accordingly, sharp large variations in tension can be absorbed by the dancer roller's movement over a wide range. Also, the speed of response of the dancer roller control unit is made sufficiently slow so as to avoid interference with control performed by the speed control unit, thereby establishing stable control over a wide range. Thus, when the tension is relatively large, only the dancer roller control unit performs control, whereas the speed control unit is idle so as to avoid an excessive correction.

When the dancer roller swings to its swing limit so as to absorb a large tension, the dancer roller must travel over a relatively long distance before it is stabilized at the central position of its swing stroke. Also, since the speed of response of the dancer roller control unit is relatively slow, the dancer roller takes a relatively long time to return to the central position of its swing stroke. Accordingly, when the tension varies again to a relatively large degree before the dancer roller reaches the central position, the dancer roller cannot swing so as to absorb the large variation in the tension.

The tension controller disclosed in Japanese Patent Application Laid-Open (kokai) No. 5-116823 requires the following various calculation values in order to control feed roller: the deviation between a predetermined tension and the detected tension of the sheet-like material; the deviation between a predetermined standard position of the dancer roller and the detected position of the dancer roller; the deviation between a predetermined dancer roller swing speed and the detected swing speed; and the deviation between a predetermined feed roller speed and the detected speed.

The calculation equations for feed roll control disclosed in this publication indicate that this feed roll control is designed so as to bring closer to zero the deviation between a value detected by each detection unit and a corresponding predetermined value.

However, bringing all of such deviations substantially to zero is difficult. Further, the use of many calculation values for control tends to make a calculation error likely to occur, resulting in reduced control accuracy. In addition, this tension controller can perform control only during printing and does not consider control for the case before printing in which a tension is small and the dancer roller is positioned at the end of its swing. As a result, there is a relatively long time between the start of printing and the stabilization of the tension. The tension controller disclosed in Japanese Patent Application Laid-Open (kokai) No. 6-127773 uses the air brake unit for the following reason. In the case where the control unit controls the rotational speed of the motor which rotates a paper roll (hereinafter referred to as the "paper roll rotating motor") based on the tension detected by the tension detection unit and an output from the encoder used for detecting the swing position of the dancer roller, the motor speed is quickly increased after operation starts, so that the dancer roller swings to the end of its swing and loses its function to adjust the tension of paper. As a result, the dancer roller hunts, and the running paper flutters. In order to solve this problem, the motor speed must be gradually increased to a predetermined speed after operation starts. However, this gradual increase of the motor speed causes the rotary press to take a longer time until it reaches its predetermined operation speed. In order to solve this problem, the air brake unit is provided so as to restrict the swinging operation of the dancer roller.

Through use of the air brake unit, the dancer roller is fixed at the central position of its swing stroke until the motor speed reaches a predetermined level after operation starts, and the rotational speed of the paper roll rotating motor is controlled by the control unit based only on the output from the tension detection unit.

When the rotary press reaches the predetermined operation speed, the control unit actuates the solenoid valve so as to release compressed air from the air brake unit, thereby allowing the dancer roller to swing. Thus, the motor speed is controlled by the control unit based on the outputs of the tension detection unit and the encoder.

Even when the motor speed is quickly increased to the predetermined speed while the dancer roller is fixed by the air brake unit, the dancer roller may not hunt and the running paper may not flutter. However, there is no other mechanism, like the dancer roller, for absorbing sharp variations in tension associated with the quick increase of the motor speed. Through only the speed control of the paper roll rotating motor, it is difficult to control the tension so as to cope with sharp variations in the tension. Consequently, the tension becomes unstable, resulting in the occurrence of drift or wrinkling of running paper.

Also, when the dancer roller is to be fixed at the central position of its swing stroke, no control feature is available for moving the dancer roller, if located away from the central position, to the central position.

The starting unit of a rotary press disclosed in Japanese Patent Application Laid-Open (kokai) No. 61-261054 comprises the dancer roller stopper adapted to mechanically hold the dancer roller at the central position of its swing stroke and mounted on the dancer roller in order to solve the following problem. In a tension controller which controls the rotational speed of an infeed roller based on the position of the dance roller detected by a dancer roller position detection unit, the tension of running paper is relatively small when operation starts or during slow operation, i.e. minimum speed operation. Accordingly, when the dancer roller is located at the end of its swing, the tension of running paper becomes unstable, resulting in the meandering of running paper or a cutting error, thus causing an increase in spoilage. In order to solve this problem, before impression is turned on, the dancer roller stopper maintains the dancer roller at the central position of its swing stroke.

After impression is turned on, the dancer roller is released from the dancer roller stopper, and tension control is performed such that the operation of the infeed roller is controlled based on the position of the dancer roller detected by the dancer roller position detection unit. However, the dancer roller is released from the dancer roller stopper after impression is turned on, i.e. after printing starts, indicating that no tension control is performed during the transitional period from impression off to impression on. Thus, the tension is unstable during this transitional period.

Also, when the dancer roller is to be fixed at the central position of its swing stroke, no control feature is available for moving the dancer roller, if located away from the central position, to the central position.

SUMMARY OF THE INVENTION

The present invention solves the above-described problems involved in the prior art. According to the present invention, when a rotary press is started or is in its minimum speed operation, a dancer roller can be easily brought to the central position of its swing stroke by balancing a tension to be established by a floating roller and a tension to be established by the dancer roller. Also, dancer roller position maintenance means is deactivated by an acceleration signal before an impression on signal is issued so as to start printing, so that printing can be started while tension control is properly performed.

Further, the displacement range of the dancer roller is divided into a plurality of regions. Based on values detected by three detection means associated with the dancer roller, namely displacement direction detection means, displacement speed detection means, and displacement position detection means, the operating time of infeed roller drive transmission regulation means is controlled so as to avoid performing control beyond that which is required. Accordingly, tension control can be performed while tension variations are minimized. Further, the tension is stabilized within a reduced period of time, and the tension control is always performed in a stable manner. In addition, the tension control is performed based only on a detected displacement of the dancer roller and without complicated calculation. An object of the present invention is to provide a tension controller having a high control accuracy which is achieved through reduction of detection and calculation errors which, in turn, is achieved through the above-described tension control.

The present invention provides a tension controller for controlling the tension of running paper web in a rotary press which includes a tension control unit for controlling an infeed roller unit arranged along a paper web path which extends between a paper web feed unit and a printing unit, the paper web feed unit being loaded with a paper roll which is rotatably supported by a support unit having a brake, the printing unit comprising a printing cylinder, and the paper web being drawn out from the paper web feed unit by the infeed roller unit. The infeed roller unit includes an infeed roller, an infeed roller drive source which commonly serves as a printing cylinder drive source, an infeed roller drive transmission connected to the infeed roller drive source and used for changing the peripheral speed of the infeed roller, infeed roller drive transmission regulation means for regulating the speed change ratio of the infeed roller drive transmission in accordance with a speed change ratio regulation signal received from the tension control unit, and a peripheral speed ratio detection unit which detects the peripheral speed ratio of the infeed roller to the printing cylinder determined by the speed change ratio of the infeed roller drive transmission and which is connected to the tension control unit so as to input a signal representing the detected peripheral speed ratio to the tension control unit. The tension controller comprises a floating roller unit disposed upstream of the infeed roller and a dancer roller unit disposed downstream of the infeed roller, and the tension control unit controls the infeed roller drive transmission regulation means and the dancer roller unit.

The floating roller unit comprises a floating roller around which paper web is looped and which can move so as to increase and decrease the length of the paper web path between the paper web feed unit and the infeed roller, a fluid cylinder for displacing the floating roller so as to increase the length of the paper web path against the tension of the running paper web, and a fluid pressure detection unit for detecting the pressure of a fluid fed to the fluid cylinder.

The dancer roller unit comprises a dancer roller around which paper web is looped and which can move so as to increase and decrease the length of the paper web path between the infeed roller and the printing unit, a fluid cylinder for displacing the dancer roller so as to increase the length of the paper web path against the tension of the running paper web, a fluid pressure change unit for changing the pressure of fluid fed to the fluid cylinder of the dancer roller, dancer roller displacement direction detection means for detecting the displacement direction of the dancer roller, dancer roller displacement speed detection means for detecting the displacement speed of the dancer roller, and dancer roller displacement position detection means for detecting the displacement position of the dancer roller (single detection means may be employed for detecting a dancer roller displacement direction, a dancer roller displacement speed, and a dancer roller displacement position). The dancer roller unit further comprises dancer roller positioning means for stationarily maintaining the dancer roller at a predetermined position.

The tension control unit receives a peripheral speed ratio detection signal from the peripheral speed ratio detection unit of the infeed roller unit, a fluid pressure detection signal from the fluid pressure detection unit of the floating roller unit, and signals related to rotary press operation such as a minimum speed operation signal, a minimum speed signal, an acceleration signal, an impression on signal, a stop signal, a sudden stop signal, an impression off signal, and a paper break signal. Based on these detection signals, a speed change ratio regulation signal is produced and input to the infeed roller drive transmission regulation means so as to control the peripheral speed ratio of the infeed roller to the printing cylinder. The tension control unit inputs a fluid pressure change signal into the fluid pressure change unit of the dancer roller unit. Further, when the dancer roller positioning means is provided, the tension control unit inputs a clamp or release signal into the dancer roller positioning means.

The operating time of the infeed roller drive transmission regulation means is controlled based on the displacement direction, displacement speed and displacement position detected by dancer roller displacement detection means for each of the divided regions of the dancer roller displacement range.

Control performed by the tension controller for controlling the tension of running paper web is classified into control performed during preparation before printing starts and control performed for reducing tension variations after the rotary press starts to increase its operation speed in order to start printing.

The tension controller for controlling the tension of running paper web initiates tension control when the rotary press is powered.

At the first stage of the control during preparation before printing starts, the dancer roller is positioned at the central standard position of its swing stroke. When the rotary press is in halt, the dancer roller is not necessarily positioned at or in the vicinity of the central standard position of its swing stroke.

Particularly, when the rotary press not loaded with paper web is loaded with paper web before printing is started, i.e. when paper web is threaded from the paper web feed unit to the printing unit, the paper web must be released from the state in which it is pressed against the infeed roller and the cylinder of the printing unit, and the brake of the paper roll support unit must be released. Therefore, the paper web is slack.

Also, the fluid cylinder of the floating roller unit is previously fed with a pressure fluid having a predetermined pressure, i.e. a first stationary pressure. Based on the detected fluid pressure indicated by a detection signal received from the fluid pressure detection unit, the tension control unit outputs a fluid pressure change signal so as to operate the fluid pressure change unit. Through this operation of the fluid pressure change unit, the pressure of the fluid fed to the fluid cylinder of the dancer roller is increased to a second stationary pressure so that the tension provided by the fluid cylinder balances with the tension of the paper web that is determined by the predetermined pressure applied to the floating roller. Before performing control for positioning the dancer roller at the central standard position of its swing stroke, the tension control unit outputs a fluid pressure change signal which causes the fluid pressure change unit to operate so as to change the pressure of the pressure fluid, which is fed to the fluid cylinder of the dancer roller, from the second stationary pressure to a larger third stationary pressure.

When the pressure fluid having the first stationary pressure is fed to the fluid cylinder of the floating roller unit, and the pressure fluid having the third stationary pressure is fed to the fluid cylinder of the dancer roller unit, the floating roller and the dancer roller are both positioned at respective slack-side end positions.

In the above-described state, the paper web extending from a paper roll is threaded along the paper web path which extends up to the printing cylinder along the floating roller, the infeed roller, and the dancer roller, and is further threaded up to an unillustrated folding unit.

When the rotary press is started after the routing of the paper web is completed, the printing cylinder is rotatively driven, and the infeed roller is also rotatively driven via the infeed roller drive transmission. As a result, the paper web runs along the paper web path.

In the above-described state, when the brake of the paper roll support unit is operated, a tension acts on the running paper web. The brake is controlled such that this tension causes the floating roller to move toward the central position of its swing and then balances with the predetermined pressure of the floating roller, i.e. the first stationary pressure of the pressure fluid fed to the fluid cylinder of the floating roller unit while the floating roller is maintained at the central position of its swing stroke. In this case, the dancer roller is positioned at the slack-side end position.

Control for positioning the dancer roller at the central standard position of its swing stroke starts when the following conditions are established: the dancer roller is positioned at the slack-side end position; positioning the floating roller at the central position of its swing stroke is completed; and an operation signal to start the operation of the rotary press is issued.

The fact that the dancer roller is positioned at the slack-side end position is detected by the displacement position detection means. Through reception of this detection signal, the tension control unit confirms the fact.

When the rotary press starts operation, the fluid pressure detection unit detects the pressure of the pressure fluid fed to the fluid cylinder of the floating roller unit. This detection signal is input to the tension control unit, so that the tension control unit detects the tension-inducing pressure of the floating roller. Based on the detected tension-inducing pressure, the tension control unit inputs a relevant fluid pressure change signal to the fluid pressure change unit. Based on the fluid pressure change signal, the fluid pressure change unit reduces the pressure of the pressure fluid fed to the fluid cylinder of the dancer roller unit below the pressure detected by the fluid pressure detection unit.

Accordingly, the tension of the running paper web causes the dancer roller to move toward the central position of its swing stroke. The fact that the dancer roller is positioned at the central position of its swing stroke is detected by the displacement position detection means, which then inputs a detection signal representing the fact to the tension control unit. Based on the received detection signal, the tension control unit inputs a fluid pressure change signal to the fluid pressure change unit. Based on the received fluid pressure change signal, the fluid pressure change unit causes the pressure of the pressure fluid fed to the fluid cylinder of the dancer roller to change to the aforementioned second stationary pressure, thereby balancing the tension-inducing pressure between the floating roller and the dancer roller through use of a force of the fluid cylinder and thus maintaining the dancer roller at the central standard position of its swing stroke.

At the second stage of control during preparation before printing starts, control is performed so as to mechanically fix the dancer roller position by the dancer roller positioning means of the dancer roller unit while the dancer roller is positioned at the central standard position of its swing stroke as described above.

While the rotary press is operating at its minimum speed (crawling) or less (including halt), and the displacement position detection means detects the fact that the dancer roller is positioned at the central standard position of its swing stroke, and also a detection signal issued by the displacement position detection means is input to the tension control unit, the dancer roller positioning means operates in accordance with a dancer roller position maintenance signal output from the tension control unit, thereby fixing the dancer roller at or in the vicinity of the central standard position of its swing stroke.

This fixation of the dancer roller position prevents the dancer roller position from varying in response to an increase in the tension of the paper web during an inching operation performed before printing starts or upon rotational displacement of a paper roll. When the speed of the operating rotary press exceeds the minimum speed, and an acceleration signal is input to the tension control unit, the tension control unit outputs a dancer roller release signal that enables the dancer roller to move.

Accordingly, when a first control, i.e. control for positioning the dancer roller at the central standard position of its swing stroke, is performed, and subsequently the rotary press shifts to a normal printing speed operation, the above-described second stage of control performed by the dancer roller positioning means may be omitted.

At the third stage of control during preparation before printing starts, the rotational speed of the infeed roller is controlled.

At adequate timing before printing starts, i.e. before an impression on signal is output, the peripheral speed ratio detection unit for the infeed roller detects the peripheral speed ratio of the infeed roller to the printing cylinder and inputs a relevant detection signal to the tension control unit. The tension control unit compares the received peripheral speed ratio with a predetermined peripheral speed ratio. When the received peripheral speed ratio is different from the predetermined peripheral speed ratio, the tension control unit outputs a speed change ratio regulation signal to the infeed roller drive transmission regulation means so as to change the peripheral speed, i.e. the rotational speed of the infeed roller to thereby attain the predetermined peripheral speed ratio.

Upon reception of the speed change ratio regulation signal, the infeed roller drive transmission regulation means causes the infeed roller drive transmission to change the rotational speed of the infeed roller so that the peripheral speed ratio of the infeed roller to the printing cylinder becomes the predetermined peripheral speed ratio.

Through the above-described control performed before printing starts, proper conditions for carrying out a normal printing speed operation are established by the rotary press completes a minimum speed operation.

In the tension control of the paper web performed after the rotary press starts to increase its operation speed in order to start printing, the displacement direction of the dancer roller is detected by the displacement direction detection means, the displacement speed of the dancer roller is detected by the displacement speed detection means, and the displacement position of the dancer roller is detected by the displacement position detection means. Based on these detected values, the feed rate of the paper web fed to the dancer roller is reduced to thereby increase the tension of the paper web which passes on the dancer roller, or the feed rate of the paper web fed to the dancer roller is increased to thereby decrease the tension of the paper web which passes on the dancer roller, thereby maintaining the dancer roller at or in the vicinity of the central standard position of its swing stroke.

That is, based on the above-described detected displacement speed, displacement direction, and displacement position of the dancer roller, the operating time of the infeed roller drive transmission regulation means is varied to regulate the amount of an increase or decrease in the peripheral speed of the infeed roller. Through this tension control, variations in the tension can be minimized against disturbances such as an increase or decrease in the operation speed of the rotary press.

Specifically, as soon as the rotary press begins to increase its operation speed, the tension control unit, which has received an acceleration signal, issues a signal to make the dancer roller positioning means ineffective, thereby enabling the dancer roller to move. Accordingly, the tension of the paper web looped around and fitted to the dancer roller is maintained in a balancing manner with the second stationary pressure of the pressure fluid fed to the fluid cylinder which acts on the dancer roller.

After beginning to increase its operation speed, the rotary press continues increasing its operation speed from the minimum speed to the normal printing speed. When an appropriate time elapses after the operation speed begins to increase, impression is turned on. As a result, the paper web is held between the printing cylinders of the printing unit and runs. Also, the paper web looped around and fitted to the infeed roller is pressed against the peripheral surface of the infeed roller.

When an appropriate time elapses after an impression on signal is input to the tension control unit, the tension control unit inputs a fluid pressure change signal to the fluid pressure change unit of the dancer roller unit. The fluid pressure change unit changes the pressure of the pressure fluid fed to the fluid cylinder from the aforementioned second stationary pressure to a higher predetermined regular operation pressure. Also, the peripheral speed of the infeed roller is varied to vary the feed rate of the paper web fed to the dancer roller, thereby regulating the tension of the paper web looped around and fitted to the dancer roller in a balancing manner with a predetermined regular operation pressure and thus performing tension control for the running paper web.

This tension control for the running paper web continues until the operation speed decreases to the minimum speed when printing is stopped, until a sudden stop signal is detected when a sudden stop occurs, or until a paper break signal is detected when the paper web breaks.

In tension control for the running paper web performed after an acceleration starts, the displacement range of the dancer roller is divided into a central insensible region, intermittent output regions located on both sides of the insensible region, and continuous output regions located on the outer sides of the intermittent output regions. When the dancer roller moves from an intermittent output region into the central insensible region at a moving rate higher than a standard rate, the tension control unit outputs a speed change ratio regulation signal to the infeed roller drive transmission regulation means so as to increase and decrease the tension of the paper web in accordance with operating conditions to thereby stop the movement of the dancer roller. Through this output of the speed change ratio regulation signal, the tension control unit causes the infeed roller drive transmission regulation means to operate only once within a short period of time to thereby accordingly regulate the peripheral speed of the infeed roller. When the dancer roller moves at a moving rate not higher than the standard rate, the tension control unit considers the tension stable and performs no control.

When in the intermittent output region, the dancer roller stays therein or moves away from the central insensible region, the tension control unit outputs a speed change ratio regulation signal to the infeed roller drive transmission regulation means so as to increase and decrease the tension of the paper web in accordance with operating conditions to thereby move the dancer roller toward the insensible region. Through this output of the speed change ratio regulation signal, the tension control unit causes the infeed roller drive transmission regulation means to intermittently operate twice or more, each for a short period of time, to thereby accordingly regulate the peripheral speed of the infeed roller.

When in the continuous output region, the dancer roller stays therein or moves away from the central insensible region, the tension control unit outputs a speed change ratio regulation signal to the infeed roller drive transmission regulation means so as to increase and decrease the tension of the paper web in accordance with operating conditions to thereby move the dancer roller toward the insensible region. Through this output of the speed change ratio regulation signal, the tension control unit causes the infeed roller drive transmission regulation means to continuously operate for a longer period of time than a control time for control within the insensible region to thereby accordingly regulate the peripheral speed of the infeed roller.

Among the above-described control operations performed in the regions of the displacement range, control performed within the intermittent control region or the continuous output region is such that when the dancer roller switches its moving direction toward the central insensible region, the tension control unit stops outputting the signal to the infeed roller drive transmission regulation means to avoid excessive control. Accordingly, tension variations involved in the control are minimized. According to this tension control, the dancer roller moves very gently in the insensible region, thereby minimizing tension variations.

When printing is to be stopped while a fourth tension control is being performed, the rotary press begins to decrease its operation speed from the normal printing speed to the minimum speed. When the rotary press enters the minimum speed operation, the paper web is released from the state of being pressed against the printing cylinder and the infeed roller in accordance with an impression off signal. Also, the tension control unit, which has received the impression off signal, inputs a fluid pressure change signal to the fluid pressure change unit of the dancer roller unit. Upon reception of the fluid pressure change signal, the fluid pressure change unit changes the pressure of the pressure fluid fed to the fluid cylinder of the dancer roller from a predetermined regular operation pressure to the aforementioned lower second stationary pressure. The fluid cylinder is actuated by the pressure fluid having the second stationary pressure and acts on the dancer roller.

The dancer roller positioning means of the dancer roller unit operates in accordance with the aforementioned second stage of control when an appropriate time elapses after the tension control unit receives a speed signal which is issued when the rotary press decelerates to the minimum speed in accordance with a stop signal.

When the rotary press makes a sudden stop in the midst of printing, the paper web is released from the state of being pressed against the printing cylinder of the printing unit and the infeed roller upon issuance of a sudden stop signal. Accordingly, the paper web extending from a paper roll to the folding unit has a constant low tension equivalent to the tension of the paper web which is established in a balancing manner at the floating roller whose fluid cylinder is fed with pressure fluid having the first stationary pressure. Thus, the dancer roller is positioned on the slack side relative to the center of its swing stroke.

After the rotary press stops in response to the sudden stop signal, the tension control unit outputs a fluid pressure change signal to the fluid pressure change unit of the dancer roller unit. Upon reception of the fluid pressure change signal, the fluid pressure change unit changes the pressure of the pressure fluid fed to the fluid cylinder of the dancer roller unit from a predetermined regular operation pressure to the aforementioned lower second stationary pressure.

Then, on condition that the dancer roller is positioned on the slack side, the tension control unit performs control so as to position the dancer roller at the central standard position of its swing stroke.

When the paper web breaks, the dancer roller positioning means remains deactivated. Receiving a paper break signal, the tension control unit outputs a fluid pressure change signal to the fluid pressure change unit of the dancer roller unit. Upon reception of the fluid pressure change signal, the fluid pressure change unit once causes the pressure fluid to be released from the fluid pressure cylinder of the dancer roller unit. Then, when the rotary press stops, the tension control unit outputs a fluid pressure change signal to the fluid pressure change unit so as to change the pressure of the pressure fluid fed to the fluid cylinder of the dancer roller unit to the second stationary pressure. This kind of control is performed as appropriate.

In the tension controller for paper web of the present invention, when the rotary press shifts from the minimum speed operation to the acceleration operation, the dancer roller begins to move from the central standard position of its swing stroke, thereby reducing time required until the tension of the paper web stabilizes and thus preventing the occurrence of drift or wrinkling of running paper with a resultant reduction in spoilage. Also, when the rotary press shifts from the minimum speed operation to the normal printing speed operation through increase of its operation speed, tension control can be minimized without performing excessive control in controlling tension variations of the paper web which passes along the dancer roller. Further, time required until the tension stabilizes can be shortened, thereby providing stable tension control all the time.

Further, values to be detected for tension control are limited to thereby avoid complicated calculation, thus providing highly accurate control.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENT

A tension controller for controlling the tension of running paper web in a rotary press according to an embodiment of the present invention will next be described with reference to the drawings.

Figure 1:
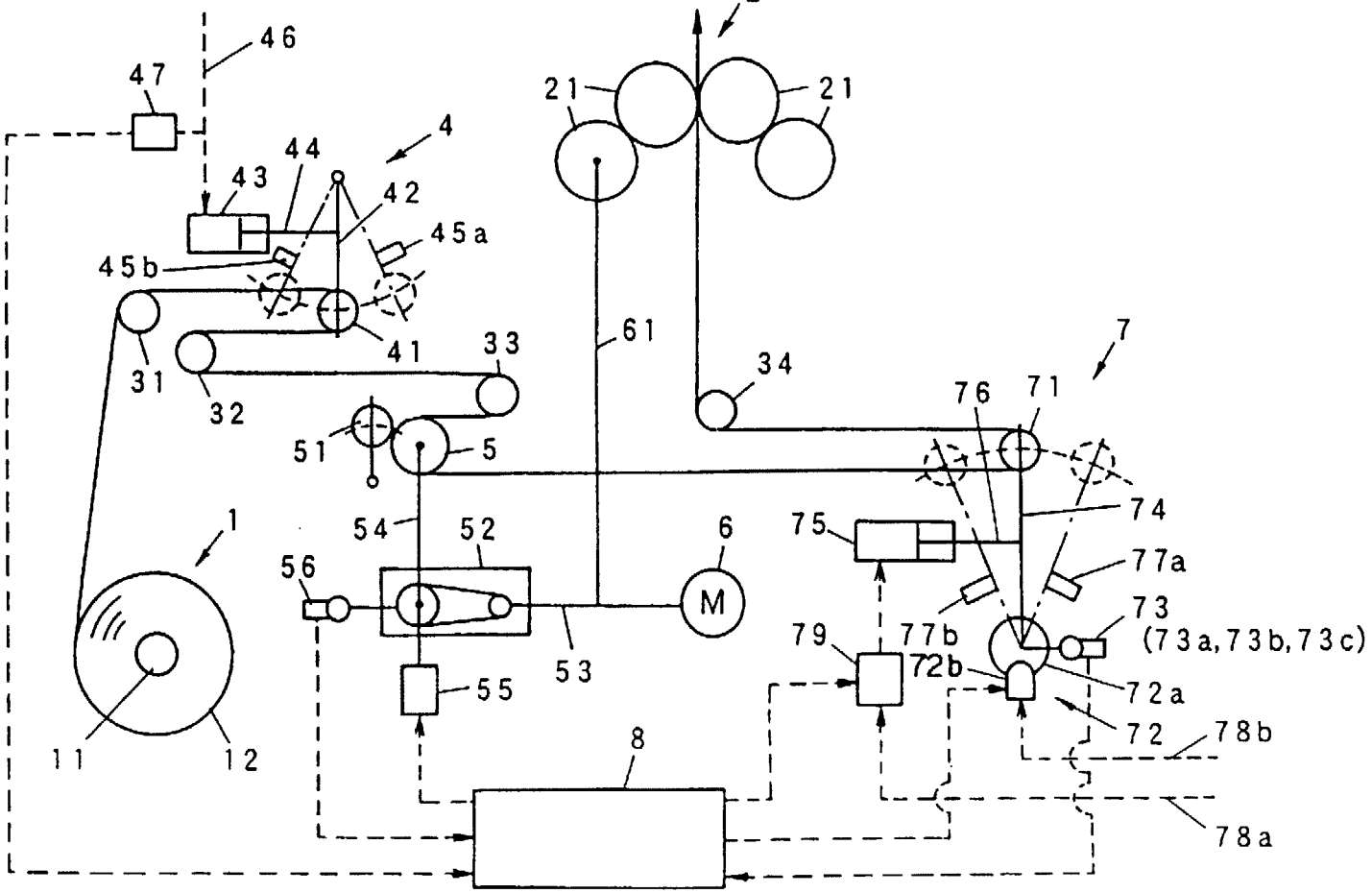
FIG. 1 is a block diagram showing the structure of a tension controller for controlling the tension of running paper web in a rotary press according to an embodiment of the present invention.

As shown in FIG. 1, in a rotary press, the tension controller for controlling the tension of running paper web is provided along a paper web path which extends between a paper web feed unit 1 and a printing unit 2. In the paper web feed unit 1, a paper roll 12 is rotatably supported by a support unit having a brake 11. The printing unit 2 comprises printing cylinders 21. Paper web W is drawn out from the paper web feed unit 1 and is threaded along the paper web path to the printing cylinders 21.

As schematically shown in FIG. 1, the path of the paper web W is formed such that the paper web W is looped around and fitted on guide rollers 31, 32, 33, and 34, a floating roller 41 of a floating roller unit 4 located between the guide rollers 31 and 32, an infeed roller 5 located between the guide rollers 33 and 34, and a dancer roller 71 of a dancer roller unit 7.

As will be described later, a nip roller 51 rotatably supported by a swing arm presses the paper web W against the peripheral surface of the rotatively driven infeed roller 5 to thereby feed and run the paper web W.

To a driving shaft 61 rotatively driven by a motor 6 are connected the printing cylinder 21 of the printing unit 2 and a driving shaft 53 serving as an input shaft of an infeed roller drive transmission 52. The infeed roller 5 is connected to a driven shaft 54 serving as an output shaft of the infeed roller drive transmission 52. Through employment of this structure, the infeed roller 5 is rotatively driven by the infeed roller drive transmission 52 at a rotational speed ratio of the driven shaft 54 to the driving shaft 53, i.e. at a peripheral speed ratio to the printing cylinder 21. Infeed roller driving speed changer regulation means 55 is connected to the tension control unit 8 so as to receive a speed change ratio regulation signal and is also connected to the infeed roller drive transmission 52 so as to finely regulate a speed change ratio of the infeed roller drive transmission 52.

As a result, the infeed roller 5 is rotatively driven at a peripheral speed ratio to the printing cylinder 21 of the printing unit 2 which is set in the infeed roller drive transmission 52. A peripheral speed ratio detection unit 56 detects a speed change ratio of the driven shaft 54 to the driving shaft 53, which is set in the infeed roller drive transmission 52, as a peripheral speed ratio of the infeed roller 5 to the printing cylinder 21, and is connected to the tension control unit 8 so as to input the detection signal thereto.

The floating roller unit 4 is adapted to regulate the tension of the paper web W extending upstream of the infeed roller 5 (between the paper web feed unit 1 and the infeed roller 5). The dancer roller unit 7 is adapted to regulate the tension of the paper web W extending downstream of the infeed roller 5 (between the infeed roller 5 and the printing unit 2).

The floating roller unit 4 is structured in the following manner. The floating roller 41 is rotatably supported by a swing arm 42 at the swing end thereof. The swing arm 42 is rotatably supported at the base end thereof. A projection end of a piston rod 44 of a pneumatic cylinder 43 is connected to the swing arm 42 at an intermediate portion thereof. The base end of the pneumatic cylinder 43 serving as a fluid cylinder is rotatably supported by a fixed member. Further, a pair of stoppers (a loose side stopper **45*a* and a tight side stopper 45*b*) are provided so as to limit the swing range of the swing arm 42**.

Being fed with compressed air from a compressed air feed pipe 46, the pneumatic cylinder 43 operates so as to project the piston rod 44. An air pressure detection unit 47 serving as a fluid pressure detection unit is provided on the compressed air feed pipe 46 in the vicinity of the pneumatic cylinder 43 and is adapted to detect the pressure of the air fed to the pneumatic cylinder 43, i.e. the internal pressure of the pneumatic cylinder 43.

The air pressure detection unit 47 is connected to the tension control unit 8 so as to input an air pressure signal thereto.

When the pneumatic cylinder 43 operates such that the piston rod 44 tends to project, and the tension of the running paper web W decreases, the swing arm 42 swings as adequate within a range extending to the slack side stopper **45*a* in FIG. 1. Accordingly, the floating roller 41 moves in such a direction that the path length of the running paper web W between the neighboring guide rollers 31 and 32 increases. By contrast, when the tension of the running paper web W increases, the swing arm 42 swings as adequate within a range extending to the tight side stopper 45*b* in FIG. 1. Accordingly, the floating roller 41 moves in such a direction that the path length of the running paper web W between the neighboring guide rollers 31 and 32** decreases.

The dancer roller unit 7 is structured in the following manner. The dancer roller 71 is rotatably supported by a swing arm 74 at the swing end thereof. The swing arm 74 is rotatably supported at the base end thereof and has, at the base end thereof, dancer roller positioning means 72 (**72*a* and 72*b*) and swing detection means 73 serving as displacement direction detection means 73*a*, displacement speed detection means 73*b*, and displacement position detection means 73*c* for the dancer roller 71. A projection end of a piston rod 76 of a pneumatic cylinder 75 serving as fluid cylinder is connected to the swing arm 74 at an intermediate portion thereof. The base end of the pneumatic cylinder 75 serving as a fluid cylinder is rotatably supported by a fixed frame. Further, a pair of stoppers (a loose side stopper 77*a* and a tight side stopper 77*b*) are provided so as to limit the swing range of the swing arm 74**.

Being fed with compressed air from a compressed air feed pipe **78*a* via an air pressure change unit 79 (for example, an electropneumatic converter) serving as a fluid pressure change unit, the pneumatic cylinder 75 operates so as to project the piston rod 76. The air pressure change unit 79 is connected to the tension control unit 8 so as to receive an air pressure change signal therefrom and is adapted to regulate the pressure of air fed to the pneumatic cylinder 75 based on the air pressure change signal received from the tension control unit 8**.

When the pneumatic cylinder 75 operates such that the piston rod 76 tends to project, and the tension of the running paper web W decreases, the swing arm 74 swings as adequate within a range extending to the slack side stopper **77*a* in FIG. 1. Accordingly, the dancer roller 71 moves in such a direction that the path length of the running paper web W between the infeed roller 5 and the neighboring guide roller 34 increases. By contrast, when the tension of the running paper web W increases, the swing arm 74 swings as adequate within a range extending to the tight side stopper 77*b* in FIG. 1. Accordingly, the dancer roller 71 moves in such a direction that the path length of the running paper web W between the infeed roller 5 and the neighboring guide roller 34** decreases.

The dancer roller positioning means 72 comprises, for example, a brake disk 72*a* which is integrally fixed to the swing arm 74 at the base end thereof, and disk brake means 72*b* which is connected to a compressed air feed pipe 78*b* and is adapted to clamp the brake disk 72*a* with brake pads or release the brake disk 72*a* through reception of compressed air from the compressed air feed pipe 78*b* or release of compressed air. Further, the disk brake means 72*b* is connected to the tension control unit 8 so as to receive an electric control signal therefrom and is adapted to receive compressed air from the compressed air feed pipe 78*b* or release compressed air in accordance with the received electric control signal.

Serving as three detection means, i.e. the displacement detection means 73*a* for detecting the swing direction of the swing arm 74 (i.e., the displacement direction of the dancer roller 71), the displacement speed detection means 73*b* for detecting the swing speed of the swing arm 74 (i.e., the displacement speed of the dancer roller 71), and the displacement position detection means 73*c* for detecting the swing position of the swing arm 74 (i.e., the displacement position of the dancer roller 71), the swing detection means 73 (for example, a potentiometer) is mounted so as to be operated in accordance with the swing of the swing arm 74 and is connected to the tension control unit 8 so as to input the respective detection signals to the tension control unit 8.

The displacement direction detection means 73*a*, the displacement speed detection means 73*b*, and the displacement position detection means 73*c* may be provided as individual detectors.

Based on the values detected by the swing detection means 73, the tension control unit 8 outputs a speed change ratio regulation signal to the infeed roller drive transmission regulation means 55, an air pressure change signal serving as a fluid pressure change signal to the air pressure change unit 79, and a clamp or release signal to the disk brake means 72*b* of the dancer roller positioning means 72 for applying or releasing the disk brake.

In addition to the above-described signals, operation signals required for tension control are input to the tension control unit 8 from a rotary press controller (not shown). These operation signals include a minimum speed operation signal, a minimum speed signal, an acceleration signal, an impression on signal, a stop signal, a sudden stop signal, an impression off signal, and a paper break signal.

The operation of the tension controller having the above-described structure will next be described.

Control performed by the tension controller for controlling the tension of running paper web is divided into a first control, a second control, and a third control, which are performed during preparation before printing starts, and a fourth control for minimizing tension variations which occur after the rotary press begins to increase its operation speed for starting printing. Tensile force control performed by the tension controller for controlling the tension of running paper web is initiated when the rotary press is powered.

1. First control during preparation before printing starts

The first control is performed for positioning the dancer roller 71 at the central standard position of its swing stroke. When the rotary press is in halt, the dancer roller 71 is not necessarily positioned in the vicinity of the central standard position.

Particularly, when the rotary press not loaded with the paper web W is loaded with the paper web W before printing is started, i.e. when the paper web is threaded from the paper web feed unit 1 to the printing unit 2, the nip roller 51 must be released from the infeed roller 5 to cancel nipping, the printing cylinders 21 of the printing unit 2 must be released from one another to cancel nipping, and the brake 1 of the support unit for the paper roll R must be released. Therefore, the paper web W is slack.

Also, under the control of the rotary press controller (not shown), the pneumatic cylinder 43 of the floating roller 41 is previously fed with compressed air which is fed from the air feed pipe 46 and which has a predetermined pressure, i.e. a first stationary pressure, which will be described later.

Based on a detected air pressure indicated by a detection signal received from the air pressure detection unit 47, the tension control unit 8 outputs an air pressure change signal so as to operate the air pressure change unit 79. Through this operation of the air pressure change unit 79, the pressure of the compressed air fed to the pneumatic cylinder 75 of the dancer roller 71 is changed to a second stationary pressure so that the force produced by the pneumatic cylinder 75 balances with the tension of the paper web W which is determined by the predetermined pressure applied to the floating roller 41. Before performing control for positioning the dancer roller 71 at the central standard position of its swing stroke, the tension control unit 8 outputs an air pressure change signal which causes the air pressure change unit 79 to operate so as to change the pressure of compressed air, which is fed from the compressed air feed pipe 78*a* to the pneumatic cylinder 75 of the dancer roller 71, from the second stationary pressure to a larger third stationary pressure.

When compressed air having the first stationary pressure is fed to the pneumatic cylinder 43 of the floating roller 41, and compressed air having the third stationary pressure is fed to the pneumatic cylinder 75 of the dancer roller 71, the piston rod 44 and the piston rod 76 are positioned at their advance positions. That is, the swing arm 42 of the floating roller 41 is in contact with the slack side stopper 45*a*, and the swing arm 74 of the dancer roller 71 is in contact with the slack side stopper 77*a*. Thus, the floating roller 41 and the dancer roller 71 are both positioned at the slack-side end positions of their swings.

In the above-described state, the paper web W extending from the paper roll R is threaded along the paper web path which extends up to the printing cylinders 21 along the guide roller 31, the floating roller 41, the guide roller 32, the guide roller 33, the infeed roller 5, the dancer roller 71, and the guide roller 34.

When the motor 6 is started after the threading of the paper web W is completed, the printing cylinders 21 are rotatively driven via the driving shaft 61, and the infeed roller 5 is also rotatively driven via the infeed roller drive transmission 52 and the driven shaft 54. As a result, the paper web W runs along the paper web path.

In the above-described state, when the brake 11 of the paper roll support unit is operated, a tension acts on the running paper web W. The thus-generated tension acts so as to move the floating roller 41 toward the central position of its swing stroke. Thus, the swing arm 42 of the floating roller 41 swings clockwise (FIG. 1), and the piston rod 44 retracts accordingly. The brake 11 is controlled such that this tension balances with the predetermined pressure of the floating roller 41, i.e. the first stationary pressure of compressed air fed to the fluid cylinder 43 of the floating roller 41 while the floating roller 41 is maintained at the central position of its swing stroke. In this case, the dancer roller 71 is positioned at the slack-side end position and is in contact with the slack side stopper 77*a*.

Control for positioning the dancer roller 71 at the central standard position of its swing stroke starts when the following conditions are established: positioning the floating roller 41 at the central position of its swing stroke is completed; and an operation signal to start the operation of the rotary press is issued from the rotary press controller (not shown).

The fact that the dancer roller 71 is positioned at the slack-side end position, i.e. the swing arm 74 is in contact with the slack side stopper 77*a* is detected by the displacement position detection means 73*c*. Through reception of this detection signal, the tension control unit 8 confirms the fact.

When the rotary press starts operation, the air pressure detection unit 47 detects the pressure of compressed air fed to the pneumatic cylinder 43. This detection signal is input to the tension control unit 8, so that the tension control unit 8 detects the tension-inducing pressure of the floating roller 41. Based on the detected tension-inducing, the tension control unit 8 determines an air pressure changing signal and inputs the air pressure change signal to the air pressure change unit 79. Based on the air pressure change signal, the air pressure change unit 79 reduces the pressure of compressed air, which is fed to the pneumatic cylinder of the dancer roller 71 from the compressed air feed pipe 78*a*, below the pressure detected by the air pressure detection unit 47.

Accordingly, the tension of the running paper web W causes the dancer roller 71 to move toward the central position of its swing stroke (insensible region I to be described later). Thus, the swing arm 74 of the dancer roller 71 swings counterclockwise (FIG. 1), and the piston rod 76 retracts accordingly. The fact that the swing arm 74 has swung counterclockwise (FIG. 1), i.e. the dancer roller 71 is positioned at the central standard position of its swing stroke is detected by the displacement position detection means 73*c*, which then inputs a detection signal representing the fact to the tension control unit 8. Based on the received detection signal, the tension control unit 8 inputs an air pressure change signal to the air pressure change unit 79.

Based on the received air pressure change signal, the air pressure change unit 79 causes the pressure of compressed air, which is fed to the pneumatic cylinder of the dancer roller 71 from the compressed air feed pipe 78*a*, to change to the aforementioned second stationary pressure, thereby balancing the tension-inducing pressure between the floating roller 41 and the dancer roller 71 through use of a pressing force applied to the swing arm 42 by the pneumatic cylinder 43 and a pressing force applied to the swing arm 74 by the pneumatic cylinder 75 and thus maintaining the dancer roller 71 at the central standard position of its swing stroke.

2. Second control during preparation before printing starts

Second control is performed so as to mechanically fix the position of the dancer roller 71 by the dancer roller positioning means 72 of the dancer roller unit 7 while the dancer roller 71 is positioned at the central standard position of its swing stroke as described above.

Figure 2:
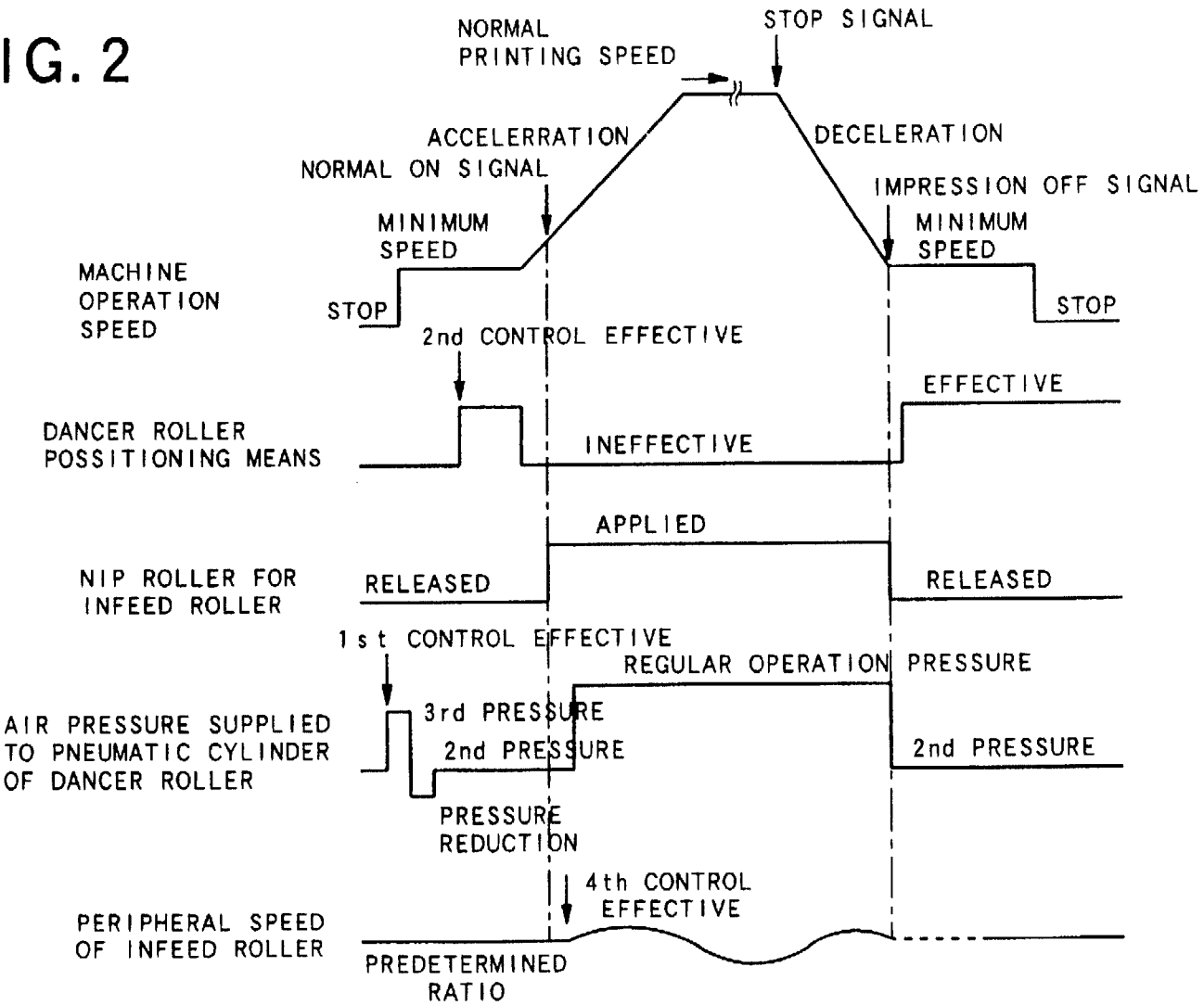
FIG. 2 is a timing chart showing tension control operations of various means in the tension controller of FIG. 1 while a dancer roller is positioned at the central standard position of its swing stroke.

As shown in FIG. 2, while the rotary press is operating at its minimum speed or less (including halt), and the displacement position detection means 73*c* detects the fact that the dancer roller 71 is positioned at the central standard position of its swing stroke, and also a detection signal issued by the displacement position detection means 73*c* is input to the tension control unit 8, the disk brake means 72*b* of the dancer roller positioning means 72 operates in accordance with a clamp signal indicative of the maintenance of the dancer roller position output from the tension control unit 8, thereby clamping the brake disk 72*a* with brake pads through application of compressed air fed from the compressed air feed pipe 78*b*.

That is, the dancer roller 71 is positioned at or in the vicinity of the central standard position of its swing stroke. This mechanical fixation of the dancer roller 71 prevents the position of the dancer roller 71 from varying in response to an increase in the tension of the paper web W during an inching operation performed before printing starts or upon displacement of a rotating paper roll. When the speed of the operating rotary press exceeds the minimum speed, and an acceleration signal is input to the tension control unit 8, a dancer roller release signal output to be the tension control unit 8 causes compressed air to be released from the disk brake means 72*b*. Thus, the brake pads release the brake disk 72*a*.

Accordingly, when the first control, i.e. control for positioning the dancer roller 71 at the central standard position of its swing stroke, is performed, and subsequently the rotary press shifts to a normal printing speed operation in accordance with an acceleration signal issued from the rotary press controller (not shown), the above-described second control performed by the dancer roller positioning means 72 may be omitted.

3. Third control during preparation before printing starts

The third control is performed for controlling the rotational speed of the infeed roller 5.

At adequate timing before printing starts, i.e. before an impression on signal is output from the rotary press controller (not shown), the peripheral speed ratio detection unit 56 for the infeed roller 5 detects the peripheral speed ratio of the infeed roller 5 to the printing cylinder 21 and inputs a relevant detection signal to the tension control unit 8. The tension control unit 8 compares the received peripheral speed ratio with a predetermined peripheral speed ratio. When the received peripheral speed ratio is different from the predetermined peripheral speed ratio, the tension control unit 8 outputs a speed change ratio regulation signal to the infeed roller drive transmission regulation means 55 so as to change the peripheral speed, i.e. the rotational speed of the infeed roller 5 to thereby attain the predetermined peripheral speed ratio.

Upon reception of the speed change ratio regulation signal, the infeed roller drive transmission regulation means 55 causes the infeed roller drive transmission 52 to change the rotational speed of the infeed roller 5 so that the peripheral speed ratio of the infeed roller 5 to the printing cylinder 21 becomes the predetermined peripheral speed ratio.

4. Fourth control for controlling paper web after the rotary press begins to increase speed for starting printing The above-described first, second, and third controls establish proper conditions for performing the normal printing speed operation by the rotary press begins to increase speed for starting printing, i.e. the rotary press completes the minimum speed operation.

That is, as shown in FIG. 2, when the rotary press is in halt, the disk brake means 72*b* of the dancer roller positioning means 72 of the dancer roller unit 7 is in an effective state. Thus, the brake pads grip the brake disk 72*a* to thereby maintain the swing arm 74, i.e. the dancer roller 71, at the central standard position of its swing stroke, and the nip roller 51 is released from the infeed roller 5.

Also, compressed air having the second stationary pressure, which is set by the air pressure change unit 79, is fed to the pneumatic cylinder 75 of the dancer roller unit 7 from the compressed air feed pipe 78*a*.

While the above-described state is maintained, the rotary press starts the minimum speed operation, the infeed roller 5 begins to rotate at a peripheral speed predetermined by the infeed roller drive transmission 52, and the paper web W also starts to run.

In the fourth control for controlling the tension of the paper web W performed after the rotary press starts to increase its operation speed in order to start printing, the displacement direction of the dancer roller is detected by the displacement direction detection means 73*a*, the displacement speed of the dancer roller is detected by the displacement speed detection means 73*b*, and the displacement position of the dancer roller is detected by the displacement position detection means 73*c*. Based on these detected values, the feed rate of the paper web W fed to the dancer roller 71 is reduced to thereby increase the tension of the paper web W which passes on the dancer roller 71, or the feed rate of the paper web W fed to the dancer roller is increased to thereby decrease the tension of the paper web W which passes on the dancer roller 71, thereby maintaining the dancer roller 71 at or in the vicinity of the central standard position of its swing stroke.

That is, based on the above-described detected displacement speed, displacement direction, and displacement position of the dancer roller 71, the operating time of the infeed roller drive transmission regulation means 55 of the infeed roller 5 is varied to regulate the amount of an increase or decrease in the peripheral speed of the infeed roller 5. Through this tension control, variations in the tension can be minimized against disturbances such as an increase or decrease in the operation speed of the rotary press.

Specifically, as shown in the time chart of FIG. 2, as soon as the rotary press begins to increase its operation speed under an instruction from the rotary press controller (not shown), the disk brake means 72*b* enters a release state in accordance with a signal received from the tension control unit 8, which has received an acceleration signal from the rotary press controller (not shown). Thus, the brake pads release the brake disk 72*a*, thereby enabling the swing arm 74 to swing, i.e. the dancer roller 71 to move. Accordingly, the tension of the paper web W looped around and fitted to the dancer roller 71 is maintained in a balancing manner with the second stationary pressure of compressed air fed to the pneumatic cylinder 75 which acts on the dancer roller 71.

After beginning to increase its operation speed, the rotary press continues increasing its operation speed from the minimum speed to the normal printing speed. When an appropriate time elapses after the operation speed begins to increase, impression is turned on under an instruction from the rotary press controller (not shown). As a result, the paper web W is held between the printing cylinders 21 of the printing unit 2 and runs. Also, the nip roller 51 operates so as to press the paper web W, which is looped around and fitted to the infeed roller 5, against the peripheral surface of the infeed roller 5, thereby preventing the running paper web W from slipping.

When an appropriate time, for example, several seconds elapse after an impression on signal is input to the tension control unit 8, the tension control unit 8 inputs an air pressure change signal to the air pressure change unit 79 of the dancer roller unit 7. The air pressure change unit 79 changes the pressure of compressed air fed to the pneumatic cylinder 75 from the aforementioned second stationary pressure to a higher predetermined regular operation pressure. This causes the pneumatic cylinder 75 to operate so as to swing the swing arm 74 clockwise in FIG. 1, thereby moving the dancer roller 71 to the right in FIG. 1.

Accordingly, the tension of the paper web W looped around and fitted to the dancer roller 71 is regulated in a balancing manner with a predetermined regular operation pressure, thus performing tension control for the running paper web W.

Figure 4:
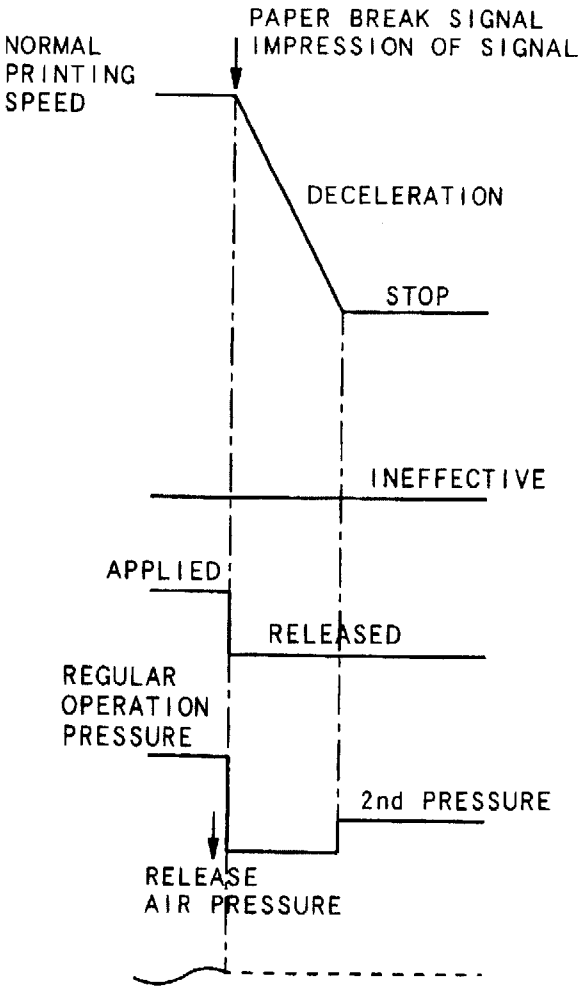
FIG. 4 is a timing chart showing tension control operations of various means in the tension controller of FIG. 1 when paper web breaks in the rotary press.
Figure 3:
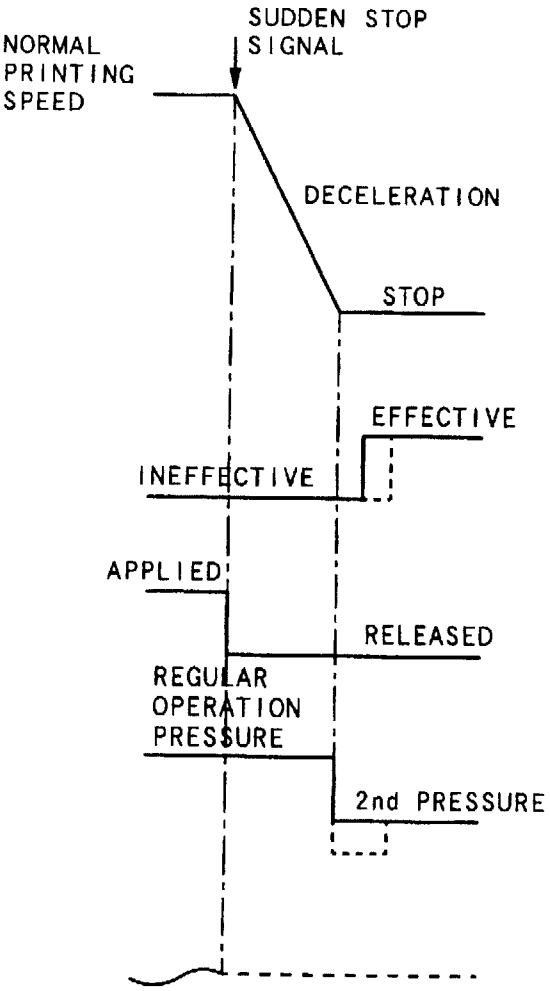
FIG. 3 is a timing chart showing tension control operations of various means in the tension controller of FIG. 1 when the rotary press stops suddenly.

This tension control for the running paper web W continues until the operation speed decreases to the minimum speed when printing is stopped. As shown in FIG. 3, when the rotary press stops suddenly, the tension control continues until a sudden stop signal is detected. As shown in FIG. 4, when the paper web W breaks, the tension control continues until a paper break signal is detected.

Figure 5:
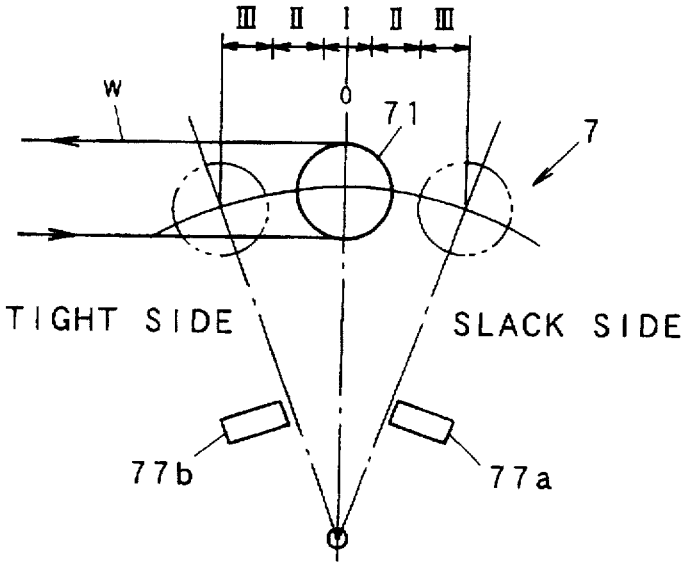
FIG. 5 is a schematic diagram showing divisional regions of the displacement range of the dancer roller of the rotary press for use in control performed by the tension controller of FIG. 1.
Figure 6:
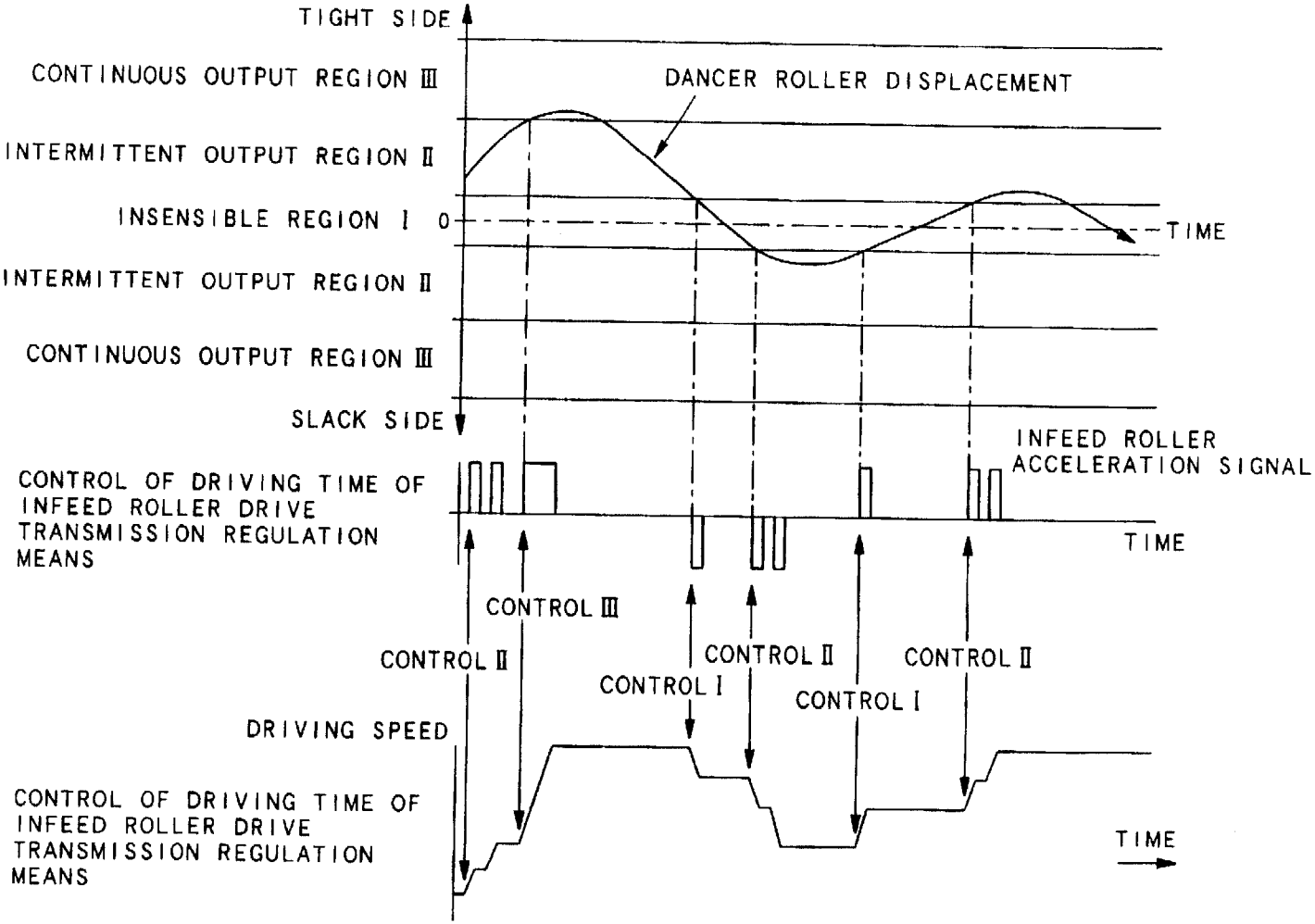
FIG. 6 is a diagram showing control of the position of the dancer roller, control of the driving time and drive speed of infeed roller drive transmission regulation means in tension control which is performed by the tension controller of FIG. 1 after the rotary press begins to increase speed for starting printing.

In tension control for the running paper web W performed after an acceleration starts, the displacement range of the dancer roller 71 is divided into, for example, the following five regions of three kinds as shown in FIG. 5: central insensible region I, intermittent output regions II located on both sides of the insensible region I, and continuous output regions III, each located on the outer side of each intermittent output region II. In each region of the displacement range, the driving time of the infeed roller drive transmission regulation means 55 is controlled accordingly.

When the dancer roller moves from either of the intermittent output regions II into the central insensible region I at a moving rate higher than a standard rate, the tension control unit 8 outputs a speed change ratio regulation signal to the infeed roller drive transmission regulation means 55 so as to increase and decrease the tension of the paper web W in accordance with operating conditions to thereby stop the movement of the dancer roller 71. Through this output of the speed change ratio regulation signal, the tension control unit 8 causes the infeed roller drive transmission regulation means 55 to operate only once within a short period of time to thereby accordingly regulate the peripheral speed of the infeed roller 5. When the dancer roller moves at a moving rate not higher than the standard rate, the tension control unit 8 considers the tension stable and performs no control.

When in the intermittent output region II, the dancer roller stays therein or moves away from the central insensible region I, the tension control unit 8 outputs a speed change ratio regulation signal to the infeed roller drive transmission regulation means 55 so as to increase and decrease the tension of the paper web W in accordance with operating conditions to thereby move the dancer roller 71 toward the insensible region I. Through this output of the speed change ratio regulation signal, the tension control unit 8 causes the infeed roller drive transmission regulation means 55 to intermittently operate twice or more, each for a short period of time, to thereby accordingly regulate the peripheral speed of the infeed roller 5.

When in the continuous output region III, the dancer roller stays therein or moves away from the central insensible region I, the tension control unit 8 outputs a speed change ratio regulation signal to the infeed roller drive transmission regulation means 55 so as to increase and decrease the tension of the paper web W in accordance with operating conditions to thereby move the dancer roller 71 toward the insensible region I. Through this output of the speed change ratio regulation signal, the tension control unit 8 causes the infeed roller drive transmission regulation means 55 to continuously operate for a longer period of time than a control time for control within the insensible region I to thereby accordingly regulate the peripheral speed of the infeed roller 5.

Among the above-described control operations performed in the five regions of the displacement range, control performed within the intermittent control region II or the continuous output region III is such that when the dancer roller 71 switches its moving direction toward the central insensible region I, the tension control unit 8 stops outputting the signal to the infeed roller drive transmission regulation means 55 to avoid excessive control. Accordingly, tension variations involved in the control are minimized. According to this tension control, the dancer roller 71 moves very gently in the insensible region I, thereby minimizing tension variations.

When printing is to be stopped while the fourth tension control is being performed, the rotary press begins to decrease its operation speed from the normal printing speed to the minimum speed in accordance with a stop signal from the rotary press controller (not shown). When the rotary press enters the minimum speed operation, in accordance with an impression off signal from the rotary press controller (not shown), the printing cylinders 21 in the printing unit 2 move away from the paper web W, and the nip roller 51 also moves away from the paper web W.

Also, the tension control unit 8, which has received the impression off signal from the rotary press controller (not shown), inputs an air pressure change signal to the air pressure change unit 79 of the dancer roller unit 7. Upon reception of the air pressure change signal, the air pressure change unit 79 changes the pressure of compressed air fed to the pneumatic cylinder 75 from the predetermined regular operation pressure to the aforementioned lower second stationary pressure. This causes the pneumatic cylinder 75 to operate so as to swing the swing arm 74 clockwise in FIG. 1, thereby moving the dancer roller 71 to the right in FIG. 1.

As shown in FIG. 2, the dancer roller positioning means 72 of the dancer roller unit 7 operates in accordance with the aforementioned second control when an appropriate time, for example, several seconds elapse after the tension control unit 8 receives a speed signal which is issued when the rotary press decelerates to the minimum speed in accordance with a stop signal.

When the rotary press makes a sudden stop in the midst of printing, the paper web W is released from the state of being nipped between the infeed roller 5 and the nip roller 51 and between the printing cylinders 21 of the printing unit 2. Accordingly, the paper web W extending from the paper roll R to the folding unit has a constant low tension equivalent to the tension of the paper web W which is established in a balancing manner at the floating roller 41 whose pneumatic cylinder 43 is fed with compressed air having the first stationary pressure.

When the rotary press stops in response to the sudden stop signal, the tension control unit 8 outputs an air pressure change signal to the air pressure change unit 79 of the dancer roller unit 7. Upon reception of the air pressure change signal, the air pressure change unit 79 once changes the pressure of compressed air fed from the compressed air feed pipe 78*a* to the pneumatic cylinder 75 of the dancer roller unit 7 from the predetermined regular operation pressure higher than the second stationary pressure to a pressure lower than the second stationary pressure.

Then, through the paper web W extending between the floating roller 41 and the dancer roller 71, the floating roller 41, whose pneumatic cylinder 43 is fed with compressed air having the first stationary pressure, pulls the dancer roller 71 positioned in the continuous output region III on the side of the slack side stopper 77*a* toward the central standard position of its swing stroke. During this displacement, when an appropriate time, for example, several seconds elapse after the displacement position detection means 73*c* detects a positional shift of the dancer roller 71 from the continuous output region III to the intermittent output region II, the aforementioned second control is performed, so that the disk brake means 72*a* operates so as to maintain the dancer roller 71 in the vicinity of the central standard position of its swing stroke.

When the rotary press stops in response to the sudden stop signal, and the displacement position detection means 73*c* detects that the dancer roller 71 is positioned in other than the continuous output region III on the side of the slack side stopper 77*a*, compressed air having the second stationary pressure is fed to the pneumatic cylinder 75 of the dancer roller 71. Subsequently, when an appropriate time, for example, several seconds elapse, the aforementioned second control is performed, so that the disk brake means 72*a* operates so as to maintain the dancer roller 71 at its current position.

As shown in FIG. 4, when the paper web W breaks, the nip roller 51 moves away from the infeed roller 5 to release the paper web W. The disk brake means 72*b* does not operate, and the dancer roller positioning means 72 remains deactivated. Receiving a paper break signal, the tension control unit 8 outputs an air pressure change signal to the air pressure change unit 79 of the dancer roller unit 7. Upon reception of the air pressure change signal, the air pressure change unit 79 once causes compressed air to be released from the pneumatic cylinder 75 of the dancer roller 71. Then, when the rotary press stops, the tension control unit 8 outputs an air pressure change signal to the air pressure change unit 79 so as to change the pressure of compressed air fed from the compressed air feed pipe 78*a* to the pneumatic cylinder 75 of the dancer roller 71 from the predetermined regular operation pressure to the second stationary pressure. This kind of control is performed as appropriate.

Obviously, numerous modifications and variations of the present invention are possible in light of the above teachings. It is therefore to be understood that within the scope of the appended claims, the present invention may be practiced otherwise than as specifically described herein.

What is claimed is:

1. A tension controller for controlling the tension of running paper web in a rotary press which includes a tension control unit for controlling an infeed roller unit arranged along a paper web path which extends between a paper web feed unit and a printing unit, the paper web feed unit being loaded with a paper roll which is rotatably supported by a support unit having a brake, the printing unit comprising a printing cylinder, the paper web being drawn out from the paper web feed unit by the infeed roller unit, and the infeed roller unit including an infeed roller, an infeed roller drive source which commonly serves as a printing cylinder drive source, an infeed roller drive transmission connected to the infeed roller drive source and used for changing the peripheral speed of the infeed roller, infeed roller drive transmission regulation means for regulating the speed change ratio of the infeed roller drive transmission in accordance with a speed change ratio regulation signal received from the tension control unit, and a peripheral speed ratio detection unit which detects the peripheral speed ratio of the infeed roller to the printing cylinder determined by the speed change ratio of the infeed roller drive transmission and which is connected to the tension control unit so as to input a signal representing the detected peripheral speed ratio to the tension control unit, said tension controller comprising an floating roller unit disposed upstream of the infeed roller and a dancer roller unit disposed downstream of the infeed roller, and said tension control unit controlling the infeed roller drive transmission regulation means and the dancer roller unit, wherein said floating roller unit comprises a floating roller around which paper web is looped and which can move so as to increase and decrease the length of the paper web path between the paper web feed unit and the infeed roller, a fluid cylinder for displacing the floating roller so as to increase the length of the paper web path against the tension of the running paper web, and a fluid pressure detection unit for detecting the pressure of a fluid fed to the fluid cylinder;

said dancer roller unit comprises a dancer roller around which paper web is looped and which can move so as to increase and decrease the length of the paper web path between the infeed roller and the printing unit, a fluid cylinder for displacing the dancer roller so as to increase the length of the paper web path against the tension of the running paper web, a fluid pressure change unit for changing the pressure of fluid fed to the fluid cylinder of the dancer roller, dancer roller displacement direction detection means for detecting the displacement direction of the dancer roller, dancer roller displacement speed detection means for detecting the displacement speed of the dancer roller, and dancer roller displacement position detection means for detecting the displacement position of the dancer roller; and said tension control unit is adapted to receive a peripheral speed ratio detection signal from the peripheral speed ratio detection unit of the infeed roller unit, a fluid pressure detection signal from the fluid pressure detection unit of the floating roller unit, and signals related to rotary press operation such as a minimum speed operation signal, a minimum speed signal, an acceleration signal, an impression on signal, a stop signal, a sudden stop signal, an impression off signal, and a paper break signal, based on these detection signals, said tension control unit inputting a speed change ratio regulation signal to the infeed roller drive transmission regulation means so as to control the peripheral speed ratio of the infeed roller to the printing cylinder, as well as inputting a fluid pressure change signal into the fluid pressure change unit of the dancer roller unit.

2. A tension controller for controlling the tension of running paper web in a rotary press according to claim 1, wherein the operating time of the infeed roller drive transmission regulation means is controlled based on the displacement direction, displacement speed and displacement position detected by the dancer roller displacement detection means for each of the divided regions of the dancer roller displacement range.

3. A tension controller for controlling the tension of running paper web in a rotary press according to claim 2, wherein said dancer roller displacement direction detection means for detecting the displacement direction of the dancer roller, said dancer roller displacement speed detection means for detecting the displacement speed of the dancer roller, and said dancer roller displacement position detection means for detecting the displacement position of the dancer roller are formed as a single detection means.

4. A tension controller for controlling the tension of running paper web in a rotary press according to claim 1, wherein said dancer roller displacement direction detection means for detecting the displacement direction of the dancer roller, said dancer roller displacement speed detection means for detecting the displacement speed of the dancer roller, and said dancer roller displacement position detection means for detecting the displacement position of the dancer roller are formed as a single detection means.

5. A tension controller for controlling the tension of running paper web in a rotary press which includes a tension control unit for controlling an infeed roller unit arranged along a paper web path which extends between a paper web feed unit and a printing unit, the paper web feed unit being loaded with a paper roll which is rotatably supported by a support unit having a brake, the printing unit comprising a printing cylinder, the paper web being drawn out from the paper web feed unit by the infeed roller unit, and the infeed roller unit including an infeed roller, an infeed roller drive source which commonly serves as a printing cylinder drive source, an infeed roller drive transmission connected to the infeed roller drive source and used for changing the peripheral speed of the infeed roller, infeed roller drive transmission regulation means for regulating the speed change ratio of the infeed roller drive transmission in accordance with a speed change ratio regulation signal received from the tension control unit, and a peripheral speed ratio detection unit which detects the peripheral speed ratio of the infeed roller to the printing cylinder determined by the speed change ratio of the infeed roller drive transmission and which is connected to the tension control unit so as to input a signal representing the detected peripheral speed ratio to the tension control unit, said tension controller comprising an floating roller unit disposed upstream of the infeed roller and a dancer roller unit disposed downstream of the infeed roller, and said tension control unit controlling the infeed roller drive transmission regulation means and the dancer roller unit, wherein said floating roller unit comprises a floating roller around which paper web is looped and which can move so as to increase and decrease the length of the paper web path between the paper web feed unit and the infeed roller, a fluid cylinder for displacing the floating roller so as to increase the length of the paper web path against the tension of the running paper web, and a fluid pressure detection unit for detecting the pressure of a fluid fed to the fluid cylinder;

said dancer roller unit comprises a dancer roller around which paper web is looped and which can move so as to increase and decrease the length of the paper web path between the infeed roller and the printing unit, a fluid cylinder for displacing the dancer roller so as to increase the length of the paper web path against the tension of the running paper web, a fluid pressure change unit for changing the pressure of fluid fed to the fluid cylinder of the dancer roller, dancer roller positioning means for stationarily maintaining the dancer roller at a predetermined position, dancer roller displacement direction detection means for detecting the displacement direction of the dancer roller, dancer roller displacement speed detection means for detecting the displacement speed of the dancer roller, and dancer roller displacement position detection means for detecting the displacement position of the dancer roller; and said tension control unit is adapted to receive a peripheral speed ratio detection signal from the peripheral speed ratio detection unit of the infeed roller unit, a fluid pressure detection signal from the fluid pressure detection unit of the floating roller unit, and signals related to rotary press operation such as a minimum speed operation signal, a minimum speed signal, an acceleration signal, an impression on signal, a stop signal, a sudden stop signal, an impression off signal, and a paper break signal, based on these detection signals, said tension control unit inputting a speed change ratio regulation signal to the infeed roller drive transmission regulation means so as to control the peripheral speed ratio of the infeed roller to the printing cylinder and inputting clamp and release signals into the dancer roller positioning means, as well as inputting a fluid pressure change signal into the fluid pressure change unit of the dancer roller unit.

6. A tension controller for controlling the tension of running paper web in a rotary press according to claim 5, wherein the operating time of the infeed roller drive transmission regulation means is controlled based on the displacement direction, displacement speed and displacement position detected by the dancer roller displacement detection means for each of the divided regions of the dancer roller displacement range.

7. A tension controller for controlling the tension of running paper web in a rotary press according to claim 6, wherein said dancer roller displacement direction detection means for detecting the displacement direction of the dancer roller, said dancer roller displacement speed detection means for detecting the displacement speed of the dancer roller, and said dancer roller displacement position detection means for detecting the displacement position of the dancer roller are formed as a single detection means.

8. A tension controller for controlling the tension of running paper web in a rotary press according to claim 5, wherein said dancer roller displacement direction detection means for detecting the displacement direction of the dancer roller, said dancer roller displacement speed detection means for detecting the displacement speed of the dancer roller, and said dancer roller displacement position detection means for detecting the displacement position of the dancer roller are formed as a single detection means.

* * * * *